US006588797B1

(12) United States Patent
Blomquist

(10) Patent No.: US 6,588,797 B1
(45) **Date of Patent: *Jul. 8, 2003**

(54) REDUCED SMOKE GAS GENERANT WITH IMPROVED TEMPERATURE STABILITY

(75) Inventor: Harold R. Blomquist, Gilbert, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/292,628

(22) Filed: Apr. 15, 1999

(51) Int. Cl.[7] ..... C06B 31/32; B60R 21/28

(52) U.S. Cl. ..... 280/741; 149/36; 149/46; 149/47

(58) Field of Search ..... 649/36, 46; 149/47; 280/741

(56) References Cited

U.S. PATENT DOCUMENTS

| | | | | |
|---|---|---|---|---|
| 3,779,822 A | | 12/1973 | Stammler et al. | |
| 3,797,238 A | | 3/1974 | Iwanciow et al. | |
| 3,885,499 A | | 5/1975 | Hurley | |
| 3,940,298 A | | 2/1976 | Beckert et al. | |
| 3,954,062 A | | 5/1976 | Dunlop et al. | |
| 4,358,327 A | | 11/1982 | Reed, Jr. et al. | |
| 4,369,079 A | | 1/1983 | Shaw | |
| 4,948,439 A | * | 8/1990 | Poole et al. | 149/46 |
| 5,281,706 A | * | 1/1994 | Coburn et al. | 544/179 |
| 5,551,725 A | * | 9/1996 | Ludwig | 280/741 |
| 5,596,168 A | * | 1/1997 | Menke et al. | 149/19.4 |
| 5,773,754 A | * | 6/1998 | Yamato | 149/36 |
| 5,872,329 A | * | 2/1999 | Burns et al. | 149/36 |
| 5,917,146 A | * | 6/1999 | Hiskey et al. | 149/36 |
| 6,143,104 A | | 11/2000 | Blomquist | |
| 6,231,701 B1 | * | 5/2001 | Blomquist | 149/18 |

FOREIGN PATENT DOCUMENTS

| | | |
|---|---|---|
| EP | 0536916 | 8/1997 |

* cited by examiner

*Primary Examiner*—Edward A. Miller
(74) *Attorney, Agent, or Firm*—Tarolli, Sundheim, Covell & Tummino L.L.P.

(57) ABSTRACT

An apparatus (12) comprises an inflatable vehicle occupant protection device (20) and a gas generating composition (16) which when ignited produces gas to inflate the inflatable vehicle occupant protection device (20). The gas generating composition (16) comprises an oxidizer and a fuel. The oxidizer is an inorganic salt and the fuel is a tetrazine.

8 Claims, 1 Drawing Sheet

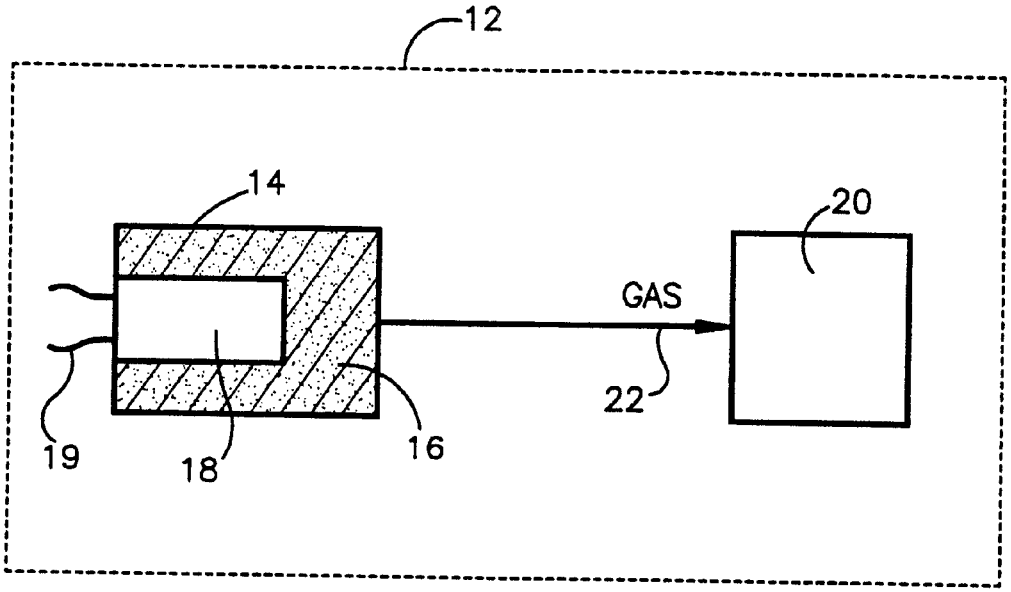
12
14
20
GAS
22
19
18
16

REDUCED SMOKE GAS GENERANT WITH IMPROVED TEMPERATURE STABILITY

FIELD OF THE INVENTION

The present invention relates to an apparatus comprising an inflatable vehicle occupant protection device, and particularly relates to a gas generating composition for providing inflation gas for inflating an inflatable vehicle occupant protection device.

BACKGROUND OF THE INVENTION

An inflator for inflating an inflatable vehicle occupant protection device, such as an air bag, contains a body of ignitable gas generating material. The inflator further includes an igniter. The igniter is actuated so as to ignite the body of gas generating material when the vehicle experiences a collision for which inflation of the air bag is desired. As the body of gas generating material burns, it generates a volume of inflation gas. The inflation gas is directed into the air bag to inflate the air bag. When the air bag is inflated, it expands into the vehicle occupant compartment and helps to protect the vehicle occupant.

Azide based gas generating compositions for generating gas to inflate an inflatable vehicle occupant protection device have the advantage that they produce gas at relatively low gas temperatures, in the range of 1100 K to 1500 K.

Non-azide based gas generating compositions, in contrast, typically produce gas at temperatures well above the cooler burning azide based gas generating compositions. While these hot burning gas generating compositions potentially are thermodynamically efficient, they present difficult heat management problems. For instance, it may be necessary, because of the high temperatures, to manufacture certain components of the vehicle occupant protection device of expensive materials resistant to the high temperature gas which is generated.

In addition, the non-azide based gas generating compositions may produce toxic reaction products which are in a vapor phase at the high temperature of combustion and thus difficult to filter. To reduce the production of toxic reaction products and achieve other advantages, it is generally desirable to achieve an oxygen balance in the combustion reaction.

A further problem with some non-azide based gas generating compositions is that the fuel molecules in the compositions may include relatively large numbers of hydrogen atoms. This can lead to the production of water and potentially steam during combustion. It is desirable to have a low water content in the exhaust gas.

SUMMARY OF THE INVENTION

The present invention is an apparatus which comprises an inflatable vehicle occupant protection device and a gas generating composition which when ignited produces gas to inflate the inflatable vehicle occupant protection device. The gas generating composition comprises an oxidizer and a fuel. The oxidizer is an inorganic salt. The fuel is a tetrazine. Preferred fuels are selected from the group consisting of 3-$R_1$-6-$R_2$-1,2,4,5-tetrazine, 3-$R_1$-6-$R_2$-1,2,4,5-tetrazine-1,4-dioxide, 1,2,3,4-tetrazine, 3-$R_1$-6-$R_2$-3,6-dihydro-1,2,4,5-tetrazine, and 3-$R_1$-6-$R_2$-1,2-dihydro-1,2,4,5-tetrazine. $R_1$ and $R_2$ are non-metallic substituents bonded to the carbon atoms at the 3 and 6 positions, respectively, of the tetrazine ring, and selected from the group consisting of: hydro; amino and derivatives thereof; tetrazolyl and derivatives thereof; triazolyl and derivatives thereof; azido and derivatives thereof; carboxyl and derivatives thereof; and mixtures thereof. $R_1$ and $R_2$ can be the same non-metallic substituent or different non-metallic substituents.

The tetrazine and tetrazine derivative molecules contain fewer carbon and/or hydrogen atoms than conventional fuel components, and thus release less heat on combustion. In addition, they can be oxygen balanced to the production of carbon dioxide with the use of less oxidizer. Further, the presence of fewer hydrogen atoms in the fuel molecule results in a lower water content in the exhaust gas which is produced.

BRIEF DESCRIPTION OF THE DRAWING

The foregoing and other features of the present invention will become more apparent to one skilled in the art upon consideration of the following description of the invention and the accompanying drawing which is a schematic illustration of an apparatus embodying the present invention.

DESCRIPTION OF THE PREFERRED EMBODIMENT

Referring to the FIGURE, an apparatus 12 embodying the present invention comprises an inflator 14. The inflator 14 contains a gas generating composition 16. The gas generating composition 16 is ignited by an igniter 18 operatively associated with the gas generating composition 16. Electric leads 19 convey current to the igniter 18 from a sensor (not shown) which is responsive to vehicle deceleration above a predetermined threshold. The apparatus 12 also comprises an inflatable vehicle occupant protection device 20. A gas flow means 22 conveys gas, which is generated by combustion of the gas generating composition 16 in the inflator 14, to the inflatable vehicle occupant protection device 20.

A preferred inflatable vehicle occupant protection device 20 is an air bag which is inflatable to protect a vehicle occupant in the event of a collision. Other vehicle occupant protection devices which can be used in the present invention are inflatable seat belts, inflatable knee bolsters, inflatable air bags to operate knee bolsters, inflatable head liners, and/or inflatable side curtains.

The gas generating composition 16 of the present invention comprises a fuel. The fuel is a tetrazine. Tetrazines are heterocyclic, six membered ring compounds containing four nitrogen atoms. Suitable tetrazines for use in the present invention include:

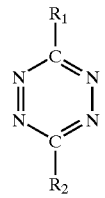

3-$R_1$-6-$R_2$-1,2,4,5-tetrazine,

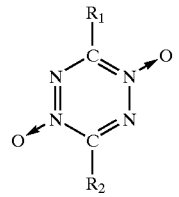

3-$R_1$-6-$R_2$-1,2,4,5-tetrazine-1,4-dioxide,

-continued

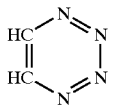

1,2,3,4-tetrazine,

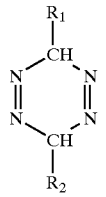

3-$R_1$-6-$R_2$-3,6-dihydro-1,2,4,5-tetrazine, and

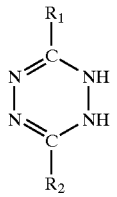

3-$R_1$-6-$R_2$-1,2-dihydro-1,2,4,5-tetrazine.

$R_1$ and $R_2$, in the respective tetrazines, are non-metallic substituents bonded to the carbon atoms at the 3 and 6 positions of the tetrazine ring. Preferably, $R_1$ and $R_2$ are selected from the group consisting of: hydro; amino and derivatives thereof such as amino-nitrate, amino-nitramide, amino-oxalic acid, hydrazino, and nitramino; tetrazolyl and derivatives thereof such as 5-aminotetrazolyl, 5-aminotetrazolyl-nitrate, 2H-tetrazolyl, 2H-tetrazolyl-ammonium salt, and hydrazinium-5-tetrazolyl; triazolyls and derivatives thereof such as 5-amino-3-nitro-1H-1,2,4-triazol-1-yl; azidos and derivatives thereof; and carboxyls and derivatives thereof such as carboxylic acid and carboxylic acid amide. $R_1$ and $R_2$ can be the same or different.

Specific examples of tetrazines that can be employed as a fuel in the present invention are: 1,2,4,5-tetrazine; 3,6-diamino-1,2,4,5-tetrazine; 3,6-diamino-1,2,4,5-tetrazine-3,6-dinitrate; 3,6-diamino-1,2,4,5-tetrazine-3,6-dinitramide; 3,6-diamino-1,2,4,5-tetrazine-3-oxalic acid; 3,6-dihydrazino-1,2,4,5-tetrazine; 3,6-dinitramino-1,2,4,5-tetrazine; 3,6-bis(5-amino-3-nitro-1H-1,2,4-triazol-1-yl)-1,2,4,5-tetrazine; 3,6-bis(5-aminotetrazol-1-yl)-1,2,4,5-tetrazine; 3,6-bis(5-aminotetrazol-1-yl)-1, 2,4,5-tetrazine; 3,6-bis(5-aminotetrazol-1-yl)-1,2,4,5-tetrazine-3,6-dinitrate; 3,6-dicarboxy-1,2,4,5-tetrazine,3,6-bis(2H-tetrazolyl-5)-1,2,4,5-tetrazine; 3,6-bis(2H-tetrazolyl-5)-1,2,4,5-tetrazine-3,6-diammonium salt; 3,6-diamino-1,2,4,5-tetrazine-1,4-dioxide; 3,6-diamino-1,2,4,5-tetrazine-1,4-dioxide-3,6-dinitrate; 3,6-diamino-1,2,4,5-tetrazine-1,4-dioxide-3,6-dinitramide; 1,2,3,4-tetrazine; 3,6-dihydro-1,2,4,5-tetrazine; 3,6-diamino-3,6-dihydro-1,2,4,5-tetrazine; 3,6-diamino-3,6-dihydro-1,2,4,5-tetrazine-3,6-dinitrate; 1,2-dihydro-1,2,4,5-tetrazine; 1,2-dihydro-1,2,4,5-tetrazine-3,6-dicarboxylic acid-diamide; 1,2-dihydro-1,2,4,5-tetrazine-3,6-dicarboxylic acid; 3,6-bis(2H-tetrazolyl-5)-dihydro-1,2,4-tetrazine; and 3,6-dihydrazinium-3,6-bis(5-tetrazolyl)-1,2-dihydro-1,2,4,5-tetrazine.

A particularly useful tetrazine in the present invention is 3-$R_1$-6-$R_2$-1,2,4,5-tetrazine-1,4-dioxide. The 3-$R_1$-6-$R_2$-1,2,4,5-tetrazine-1,4-dioxide molecule has two additional oxygen atoms bonded to the nitrogen atoms at the 1 and 4 position of the tetrazine ring by dative bonds. The additional oxygen atoms of 3-$R_1$-6-$R_2$-1,2,4,5-tetrazine-1,4-dioxide allow 3-$R_1$-6-$R_2$-1,2,4,5-tetrazine-1,4-dioxide to be oxygen balanced to the production of carbon dioxide, nitrogen, and water with the use of less oxidizer. A particularly preferred 3-$R_1$-6-$R_2$-1,2,4,5-tetrazine-1,4-dioxide is 3,6-diamino-1,2,4,5-tetrazine-1,4-dioxide (TZX).

The amount of fuel in the gas generating composition 16 is that amount necessary to achieve sustained combustion of the gas generating composition. This amount can vary depending upon the particular fuel involved and other reactants. A preferred amount of fuel component is that amount necessary to achieve an oxygen balance with the oxidizer which upon combustion produces essentially carbon dioxide, nitrogen, and water. This can be characterized as complete combustion of the fuel. Preferably, the amount of the fuel component is in the range of about 30% to about 70% by weight of the combined weight of the fuel and oxidizer.

The oxidizer in the gas generating composition of the present invention can be any inorganic oxidizer salt commonly used in a vehicle occupant protection device. A preferred oxidizer is selected from the group consisting of ammonium nitrate (AN), potassium nitrate (KN), sodium nitrate (NaN), potassium perchlorate (KP), ammonium perchlorate (AP), and combinations thereof.

When ammonium nitrate is used as the oxidizer, the ammonium nitrate is preferably phase stabilized. The phase stabilization of ammonium nitrate is well known. In one method, the ammonium nitrate is doped with a metal cation in an amount which is effective to minimize the volumetric and structural changes associated with phase transitions inherent to pure ammonium nitrate. A preferred phase stabilizer is potassium nitrate. Other useful phase stabilizers include potassium salts such as potassium dichromate, potassium oxalate, potassium perchlorate, and mixtures thereof. Ammonium nitrate can also be stabilized by doping with copper and zinc ions. Other compounds, modifiers, and methods that are effective to phase stabilize ammonium nitrate are well known and suitable in the present invention.

The amount of oxidizer in the gas generating composition is that amount necessary to achieve sustained combustion of the gas generating composition. A preferred amount of oxidizer is in the range of about 30% to about 70% by weight of the combined weight of the oxidizer and the fuel component.

The gas generating composition of the present invention preferably comprises an elastomeric binder. Suitable binders for gas generating compositions are well known in the art. Preferred binders include polycarbonates, polyurethanes, polyesters, polyethers, polysuccinates, thermoplastic rubbers, polybutadiene, polystyrene, and mixtures thereof.

A preferred amount of binder is in the range of 0 to about 10% by weight based on the weight of the gas generating composition. More preferably, the amount of binder is in the range of about 2.5% to about 10% by weight of the weight of the gas generating composition.

The gas generating composition may comprise a coolant. A preferred coolant is a metal oxide. Metal oxides also act as sinter forming materials which bind to and form solid residues with caustic materials that may be generated upon combustion of the gas generating composition. The solid residue so formed is more easily filtered in the vehicle occupant protection device during inflation.

A preferred metal oxide is one selected to optimize control of temperature, particulate production, and gas composition. More preferably the metal oxide is aluminum oxide ($Al_2O_3$). The form of the aluminum oxide may be either synthetic or natural and may contain modifiers such as other ions and metal compounds. The aluminum oxide can be intimately mixed with other ingredients or exist as discrete particles or fibers selected to optimizes control of temperature, particulate production, and gas composition.

The coolant may be present in the range of about 10% to about 25% by weight based on the weight of the gas generating composition.

The present invention may also comprise other ingredients commonly added to a gas generating composition for providing inflation gas for inflating an inflatable vehicle occupant protection device, such as plasticizers, process aids, burn rate modifiers, and ignition aids, all in relatively small amounts.

EXAMPLE 1

A gas generating composition is prepared by combining, in a conventional powder mixing device, powdered 3,6-diamino-1,2,4,5-tetrazine-1,4-dixoide (TZX) and powdered ammonium nitrate (AN) in a weight ratio of about 1:2.2 TZX to AN.

TZX has the general formula $C_2H_4N_6O_2$ and the structural formula:

TZX

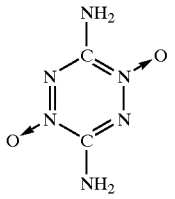

The molecular weight of TZX is 144.09. The weight percentages of the individual atoms in TZX are 16.67% carbon, 2.80% hydrogen, 58.32% nitrogen, and 22.21% oxygen.

Prior to mixing, the powders are passed through a fifty mesh screen. The weight ratio of about 1:2.2 is selected for substantially complete combustion of the gas generating composition to a gas consisting essentially of carbon dioxide, nitrogen, and water.

After combining the TZX and AN, the mixture of TZX and AN is compacted under a compaction pressure of 11,000 ft-lb (1521 kg-m) into tablets having a diameter of approximately 1.3 cm, a thickness of 0.73 cm, and a density of 1.9 g/cm$^3$.

Thermochemical calculations for the combustion of tablets of the gas generating material were performed using an ambient temperature of 298 K, a chamber pressure of 2000 psi and an exhaust pressure of 14.7 psi. The thermochemical calculation results are given in Table 1.

TABLE 1

| | |
|---|---|
| TZX wt % | 31.04 |
| AN wt % | 68.96 |
| T flame, K | 2278 |
| T exhaust, K | 900 |
| Residue, g/100 g | 0 |
| Impetus, lbfts/lbm | 316,100 |

The flame temperature, exhaust temperature, amount of residue produced, and impetus are within acceptable performance specifications for gas generating compositions for use in a vehicle occupant protection apparatus.

COMPARATIVE EXAMPLE 1

A gas generating composition was prepared comprising 5-aminotetrazole (5-AT) and reagent grade ammonium nitrate (AN) in the weight ratio of about 1:3.3 5-AT to AN. 5-AT has the general formula $CH_3N_5$ and the structural formula:

5-AT

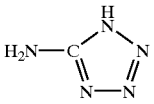

The molecular weight of 5-AT is 85.07. The weight percentages of the individual atoms are 14.12% carbon, 3.55% hydrogen, and 82.33% nitrogen. This ratio of 5-AT to AN was selected for substantially complete combustion of the fuel component to a gas consisting essentially of carbon dioxide, nitrogen, and water.

The 5-AT and AN are prepared separately as powders, screened, mixed, and compacted into tablets as in Example 1. Thermochemical calculations for the combustion of the tablets are listed in the following Table 2 along with the results for Example 1 for purposes of comparison.

TABLE 2

| | EX 1 | Comp.EX 1 |
|---|---|---|
| TZX wt % | 31.04 | — |
| 5-AT wt % | — | 23.3 |
| AN wt % | 68.96 | 76.7 |
| Residue, g/100 g | 0 | 0 |
| T Flame, K | 2278 | 2414 |
| T Exhaust, K | 900 | 1380 |

Table 2 shows that the TZX and AN composition produces a combustion gas product with a substantially lower exhaust temperature than the combustion gas product of the 5-AT and AN composition, an exhaust temperature of 900 K compared to 1380 K. Furthermore, TZX has in its molecule a lower weight percent of hydrogen relative to nitrogen than does 5-AT, a hydrogen weight percent of 2.80% compared to 3.55%. The oxidation of hydrogen releases substantial amounts of heat. Combustion of a molecule of TZX thus releases less heat than combustion of a molecule of 5-AT. Moreover, the lower weight percent of hydrogen in TZX means that the combustion of TZX will produce less water than the combustion of 5-AT. Also, Table 2 shows that the TZX and AN composition requires substantially less ammonium nitrate for complete combustion, 69% compared to 77%. This reduces the adverse effect ammonium nitrate can have on the composition, providing, by way of example, compacted tablets having improved mechanical stability.

EXAMPLES 2–6

In Examples 2–6 the fuel component is 3,6-diamino-1,2,4,5-tetrazine-1,4-dioxide (TZX) and the oxidizers are respectively: potassium nitrate (KN) (Example 2); ammonium nitrate (AN) phase stabilized with 15% potassium nitrate (KN) (Example 3); ammonium nitrate (AN) phase stabilized with 9% potassium nitrate (KN) and 6% potassium perchlorate (KP) (Example 4); potassium perchlorate (KP) (Example 5); and ammonium nitrate (AN) (Example 6). Aluminum oxide ($Al_2O_3$) is added to Example 6 as a coolant to reduce the combustion and exhaust temperatures. The formulations and combustion results are given in Table 3.

TABLE 3

| | EX 2 | EX 3 | EX 4 | EX 5 | EX 6 |
|---|---|---|---|---|---|
| TZX wt % | 47.11 | 34.02 | 33.97 | 50.98 | 23.28 |
| AN wt % | — | 56.08 | 57.45 | — | 51.72 |
| KN wt % | 52.89 | 9.90 | 5.28 | — | — |
| KP wt % | — | — | 3.30 | 49.02 | 0 |
| $Al_2O_3$ wt % | — | — | — | — | 25 |
| T flame, K | 2140 | 2199 | 2262 | 2693 | 1919 |
| T exhaust, K | 1296 | 980 | 986 | 1382 | 885 |
| Residue, g/100 g | 52.4 | 9.8 | 6.0 | 26.37 | 25.0 |
| Impetus, lbfts/lbm | 183,200 | 287,100 | 297,300 | 260,800 | 207,700 |

Referring to Table 3, Example 2 contains by weight of the gas generating composition 47.11% 3,6-diamino-1,2,4,5-tetrazine-1,4-dioxide (TZX) and 52.89% potassium nitrate (KN) for substantially complete combustion of the carbon atoms in 3,6-diamino-1,2,4,5-tetrazine-1,4-dioxide to carbon dioxide. The flame temperature, exhaust temperature, amount of residue produced, and impetus are within acceptable performance specifications for gas generating compositions used in vehicle occupant protection apparatuses. As with Example 1, the exhaust temperature is below that obtained with the combustion of 5-AT.

Example 3 contains by weight of the gas generating composition 34.02% 3,6-diamino-1,2,4,5-tetrazine-1,4-dioxide, and 56.08% ammonium nitrate (AN) phase stabilized with 9.90% potassium nitrate (KN) (15% potassium nitrate based on the weight of ammonium nitrate), for substantially complete combustion of the carbon atoms in 3,6-diamino-1,2,4,5-tetrazine-1,4-dioxide to carbon dioxide. The flame temperature, exhaust temperature, amount of residue produced, and impetus are within acceptable performance specifications for gas generating compositions used in vehicle occupant protection apparatuses. As with Example 1, the exhaust temperature is below that obtained with the combustion of 5-AT.

Example 4 contains by weight of the gas generating composition 33.97% 3,6-diamino-1,2,4,5-tetrazine-1,4-dioxide (TZX), and 57.45% ammonium nitrate (AN) phase stabilized with 5.28% potassium nitrate (KN) and 3.30% potassium perchlorate (KP) for substantially complete combustion of the carbon atoms in 3,6-diamino-1,2,4,5-tetrazine-1,4-dioxide to carbon dioxide. The flame temperature, exhaust temperature, amount of residue produced, and impetus are within acceptable performance specifications for gas generating compositions used in vehicle occupant protection apparatuses. As with Example 1, the exhaust temperature is below that obtained with the combustion of 5-AT.

Example 5 contains by weight of the gas generating composition 50.98% 3,6-diamino-1,2,4,5-tetrazine-1,4-dioxide (TZX) and 49.02% potassium perchlorate (KP) for substantially complete combustion of the carbon atoms in 3,6-diamino-1,2,4,5-tetrazine-1,4-dioxide to carbon dioxide. The combustion results are generally within acceptable performance specifications for gas generating compositions used in vehicle occupant protection apparatuses. Furthermore, the low amount of hydrogen in both the 3,6-diamino-1,2,4,5-tetrazine-1,4-dioxide and potassium perchlorate means that the combustion of % 3,6-diamino-1,2,4,5-tetrazine-1,4-dioxide and potassium perchlorate produces a gas product with a substantially reduced water content.

Example 6 contains by weight of the gas generating composition 23.28% 3,6-diamino-1,2,4,5-tetrazine-1,4-dioxide (TZX), 51.72% potassium perchlorate (KP), and 25% aluminum oxide ($Al_2O_3$) for substantially complete combustion of the carbon atoms in 3,6-diamino-1,2,4,5-tetrazine-1,4-dioxide to carbon dioxide. The exhaust temperature is further reduced as compared to the exhaust temperatures of the gas generated upon combustion of the compositions in Example 1–5, which do not contain the aluminum oxide. The amount of residue produced is increased in comparison to the amount of residue produced by the gas generating composition of Example 1. However, as a result of the addition of aluminum oxide, the residue produced from the gas generating composition of Example 6 is a solid, at exhaust temperature, which is more easily filterable in an inflatable vehicle occupant protection device. Thus, the gas generating composition of Example 6 is within acceptable performance specifications for gas generating compositions used in vehicle occupant protection apparatuses.

None of the Examples include a binder component. In actual practice, a gas generating composition useful for a vehicle occupant protection device will preferably comprise a binder to maintain the integrity of a body of the generating composition. A binder would be selected which would not materially affect the combustion results shown in the tables.

Advantages of the present invention should now be apparent. Primarily the present invention takes advantage of the favorable performance characteristics of using a tetrazine as a fuel and an inorganic salt as an oxidizer. A mixture of the oxidizer and the claimed fuel offers improved mechanical stability without sacrificing chemical stability. Furthermore, the gas generating composition of the present invention produces an improved gas product which is essentially non-toxic and free of particulates, and which has a substantial reduction in exhaust temperature. The improvements in mechanical stability and quality of the gas product accrue from the use of less oxidizer for complete combustion of the fuel component and from the use of a fuel component that contains a minimal amount of hydrogen.

From the above description of the invention, those skilled in the art will perceive improvements, changes, and modifications. Such improvements, changes and modifications within the skill of the art are intended to be covered by the appended claims.

Having described the invention, the following is claimed:

1. An apparatus comprising an inflatable vehicle occupant protection device and a gas generating composition which, when ignited, produces gas to inflate said inflatable vehicle occupant protection device, said gas generating composition comprising an inorganic salt oxidizer and a fuel, said fuel comprising 3-$R_1$-6-$R_2$-1,2,4,5-tetrazine-1,4, dioxide, wherein $R_1$ and $R_2$ are selected from the group consisting of hydrogen, amino, amino-nitrate, amino-nitramide, amino-oxalic acid, hydrazino, nitramino, tetrazolyl, 5-aminotetrazolyl, 5-aminotetrazolyl-nitrate, 2H-tetrazolyl-ammonium salt, hydrazinium-5-tetrazolyl, 5-amino-3-nitro-1H-1,2,4-triazol-1-yl, azido, carboxylic acid, and carboxylic acid amide.

2. The apparatus of claim 1 wherein the fuel is 3,6-diamino-1,2,4,5-tetrazine-1,4-dioxide.

3. The apparatus as defined in claim 1 wherein the inorganic salt oxidizer is selected from the group consisting of ammonium nitrate, potassium nitrate, potassium perchlorate, ammonium perchlorate, and combinations thereof.

4. The apparatus as defined in claim 3 wherein the oxidizer is ammonium nitrate and the ammonium nitrate is phase stabilized.

5. The apparatus of claim 1 wherein the gas generating composition further comprises about 10% to about 25% by weight based on the weight of the gas generating composition of a coolant.

6. The apparatus of claim 5 wherein the coolant is aluminum oxide.

7. The apparatus of claim 1 wherein the amount of fuel is about 30% to about 70% by weight based on the combined weight of the inorganic salt oxidizer and the hydrogen containing fuel.

8. The apparatus of claim 1 wherein the amount of inorganic salt oxidizer is about 30% to about 70% by weight of the combined weight of the fuel and the inorganic salt oxidizer.

* * * * *